US006003231A

United States Patent [19]

Leibeck et al.

[11] Patent Number: 6,003,231

[45] Date of Patent: Dec. 21, 1999

[54] COMPASS WITH ADJUSTING MEANS

[75] Inventors: Christain Leibeck, Nürnberg; Peter Weiss, Veitsbronn; Helmut Hufnagl, Schwarzenbruck, all of Germany

[73] Assignee: J. S. Staedtler GmbH & Co., Nü rnberg, Germany

[21] Appl. No.: 08/921,172

[22] Filed: Aug. 29, 1997

[30] Foreign Application Priority Data

Sep. 2, 1996 [DE] Germany ..... 196 35 599

[51] Int. Cl.[6] ..... B43L 9/02

[52] U.S. Cl. ..... 33/27.02; 33/558.012

[58] Field of Search ..... 33/27.02, 558.012

[56] References Cited

U.S. PATENT DOCUMENTS

| | | | |
|---|---|---|---|
| 19,589 | 3/1858 | Schaefer | 33/27 |
| 953,026 | 3/1910 | Evans | 33/27 |
| 1,140,844 | 5/1915 | Novak | 33/27 |
| 1,284,372 | 11/1918 | Lawrenz | 33/27 |
| 1,466,712 | 9/1923 | Green et al. | 33/27 |
| 1,925,082 | 9/1933 | Dodd | 33/27 |
| 2,333,307 | 11/1943 | Galea | 33/27 |
| 3,358,371 | 12/1967 | Liesong, Sr. | 33/27 |
| 4,843,719 | 7/1989 | Straten | 33/27 |

*Primary Examiner*—Bernard Roskoski
*Attorney, Agent, or Firm*—Friedrich Kueffner

[57] ABSTRACT

A compass with an adjusting mechanism for adjusting the compass legs and for changing the distance between the compass points, wherein each compass leg includes a pivot bearing and an adjustment bearing. Each compass leg is constructed as a two-armed lever, wherein a first lever arm of each lever extends along the compass leg axis from the pivot bearing to the compass leg point, on the one hand, and a second lever arm extends from the pivot bearing to the compass arm end. The adjustment bearing, or a tilting bearing constructed as the adjustment bearing, is arranged in the second lever arm of each two-armed lever forming a compass leg.

26 Claims, 4 Drawing Sheets

COMPASS WITH ADJUSTING MEANS

BACKGROUND OF THE INVENTION

1. Field of the Invention

The present invention relates to a compass with adjusting means for adjusting the compass legs and for changing the distance between the compass points, wherein each compass leg includes a pivot bearing and an adjustment bearing.

2. Description of the Related Art

Compasses of the above-described type are usually composed of two compass legs which are mounted in a compass head and whose points can be adjusted at certain distances relative to each other. The compass leg adjustment is effected manually and also frequently with the aid of adjusting means, particularly adjusting spindles which interact with one or more spindle nuts and which, depending on the pitch of the thread, the unlocking mechanisms or other structural means, facilitate a quick or slow adjustment or change of the distance between the points. The adjusting spindle is usually arranged axially between the compass head and the compass points at a more or less great distance from the compass head and the compass leg ends or the pivot bearings thereof, and the adjusting spindle is mounted so as to be rotatable.

A compass of the above-described type is disclosed, for example, in German utility model 18 32 209. The compass has a rack and an adjusting wheel and is provided with two bearing axes in the compass head in which the compass legs are rotatably mounted. The distance between the points can be adjusted by a turning knob acting on a rack. The fine adjustment is effected by rotating the turning knob, while the coarse adjustment is effected by an increased pressure on the points of the compass legs, wherein the rack and a pinion arranged on the turning knob mesh with each other.

German patent 1 761 101 discloses another compass which includes a rotatable adjusting spindle and an adjusting wheel arranged concentrically on the adjusting spindle. In order to facilitate a quick coarse adjustment, the adjustment spindle has a thread with a coarse pitch and is free of self-locking action. When an increased transverse pressure or tensile force is applied on the points of the compass legs, the adjusting spindle rotates automatically and causes the coarse adjustment, while the fine adjustment is to be effected by manually operating the adjusting screw.

German patent 38 36 683 discloses a similar compass in which the spindle nuts can be resiliently spread apart and can be removed from the spindle provided with a normal thread, so that a so-called quick adjustment is possible when the spindle is unlocked. The fine adjustment of the distance between the points of the compass takes place also in this case by rotating the drive wheel with the aid of the threaded spindle having a relatively fine thread.

The compasses known in the art have the disadvantage that either complicated devices or special spindles are required for a simple and particularly a quick adjustment of the compass legs. On the other hand, an adjustment of the legs with normal adjusting spindles, i.e., spindles having a fine pitch, is only possible in a relatively time consuming and difficult manner.

Another disadvantage of the known compasses is to be seen in the fact that during use, i.e., when drawing circles, it is necessary while continuously changing the center of gravity to make sure that a good contact exists between a point of the compass with a support surface, on the one hand, and of the writing tip with the recording carrier, on the other hand. This becomes more and more difficult as the drawing radius increases.

In addition, it is frequently considered to be disadvantageous that the adjustment of the distances by which the needle and the lead or writing tip protrude beyond the points of the legs influences to a significant extend the circle to be drawn. This makes it impossible to effect an acceptable scaling of the adjustment values by means of a measuring scale or other indicating means.

SUMMARY OF THE INVENTION

Therefore, it is the primary object of the present invention to provide a compass which does not have the disadvantages described above and which, in particular, can be manufactured inexpensively. The compass is to have an improved location of the center of gravity particularly when drawing middle-sized circles. In addition, a simple and quick adjustability of the compass legs is to be made possible even without special equipment or additional auxiliary means. Moreover, a better and more accurate scaling capability of the compass adjustment is to be made possible.

In accordance with the present invention, each compass leg is constructed as a two-armed lever, wherein a first lever arm of each lever extends along the compass leg axis from the pivot bearing to the compass leg point, on the one hand, and a second lever arm extends from the pivot bearing to the compass arm end. The adjustment bearing, or a tilting bearing constructed as the adjustment bearing, is arranged in the second lever arm of each two-armed lever forming a compass leg.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
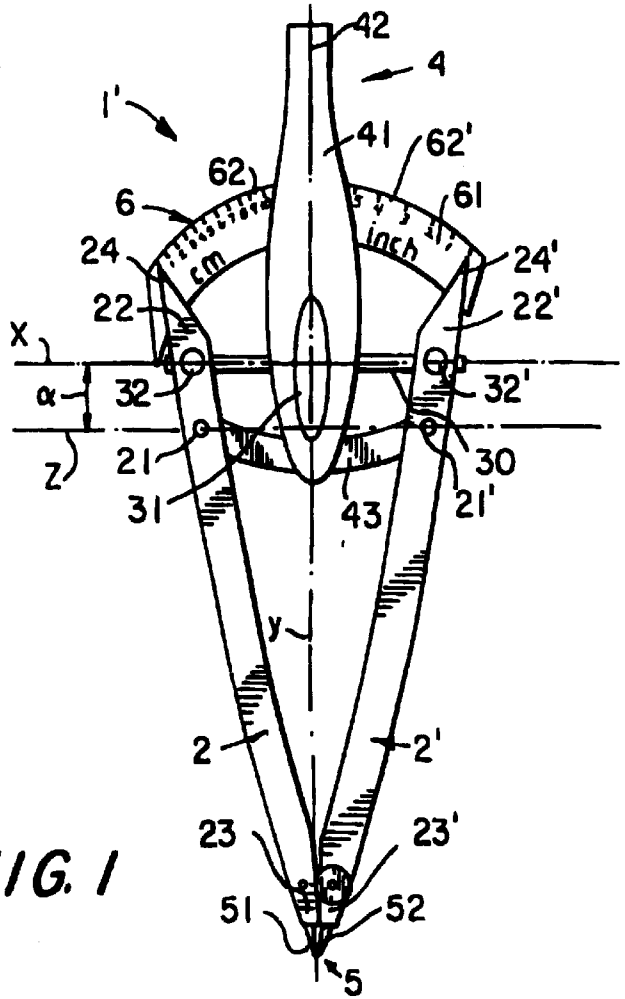
FIG. 1 is an elevational view of a first embodiment of the compass according to the present invention, shown with closed compass legs and with an adjusting scale.

FIG. 1 of the drawing shows a compass 1' with closed compass legs 2, 2' and an adjusting scale 6. The compass legs 2, 2' are slightly inwardly arched and are rotatably or tiltably fastened in pivot bearings 21, 21' at a bearing stirrup 43 which is curved and rigidly attached to the compass head 4.

A needle 52 and a lead or other writing tip 52 are received in the compass leg points 23, 23' and form the compass points 5. An adjusting axis x is located at a defined axial distance a from the bearing axis x extending perpendicularly of the compass axis y. In this embodiment, the adjusting axis x forms the center line of the adjusting spindle 40. An adjusting wheel for the adjusting spindle 30 is secured against transverse displacement but rotatably mounted in the compass head 4 provided with a grip 42. By means of adjustment bearings 32 and 32' constructed as nuts rotatable about the transverse axis thereof, the adjusting spindle effects the respective adjustment of the compass points in accordance with the lever principle, wherein a relatively short adjusting distance along the adjusting axis x causes a relatively large adjusting distance of the compass points, or of the needle 51 and the lead 52, relative to each other.

The adjusting scale 6 is composed of an arched scale carrier 61 attached to the compass head 4, wherein the scale carrier 61 has a cm-scale 62 and an inch-scale 62', and wherein the indicators 24 and 24' integrally formed at the leg ends 22 and 22' indicate the respectively adjusted value in both scales simultaneously. Since in the illustrated closed position of the compass the adjusted value is 0, the indicators 24 and 24' also are in the corresponding scale positions.

Figure 2:
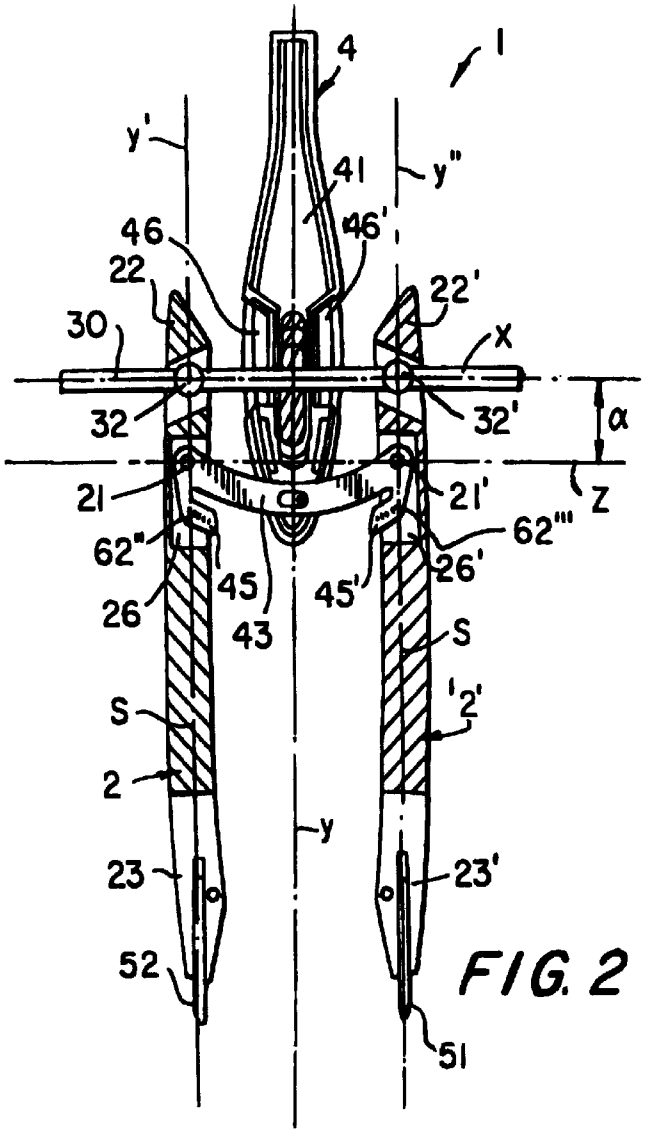
FIG. 2 is a sectional view of another embodiment of the compass, shown with the compass legs extending approximately parallel to each other.
Figure 4:
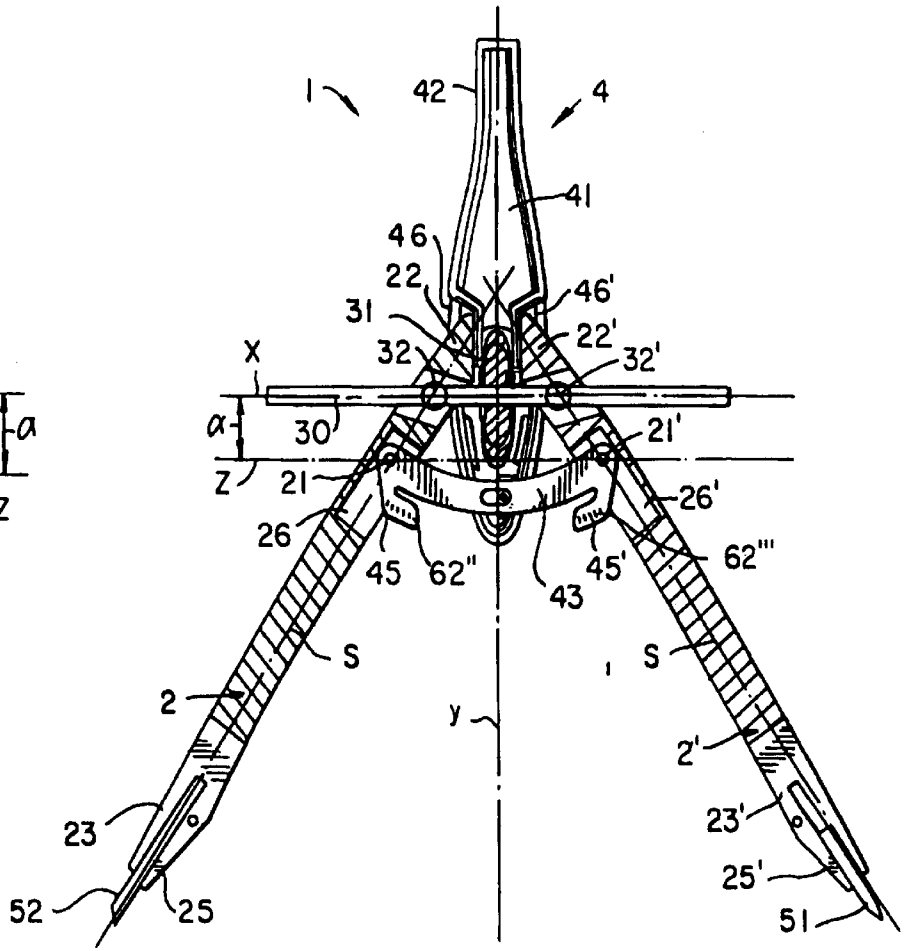
FIG. 4 is a sectional view of the compass of FIG. 2, shown with completely opened legs.
Figure 3:
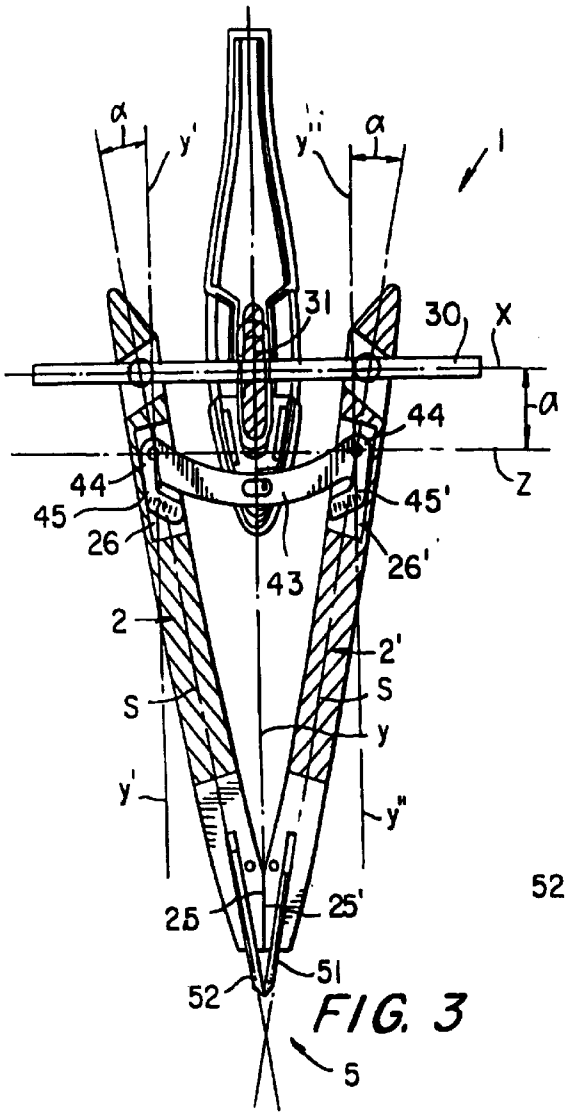
FIG. 3 is a sectional view of the compass of FIG. 2, shown with closed legs.

FIGS. 2, 3 and 4 of the drawing are sectional views of another embodiment of the compass 1, wherein FIG. 2 shows the compass with the compass legs extending approximately parallel to each other, FIG. 3 shows the compass with closed legs 2, 2' and FIG. 4 shows the compass with completely opened legs 2, 2'.

In the illustration of FIG. 2, the leg axes s and the parallel lines y' and y" to the compass axis y extend in a line, while, in the closed compass shown in FIG. 3, the leg axes s diverge above the pivot bearings 21, 21' outwardly by the angle deviation α, wherein the respective pivot point is the center point of the pivot bearings 21, 21'. When the compass is opened further beyond the parallel position, this angle deviation is located inwardly and increases up to the maximum opening which is limited by the end faces of the leg ends 22, 22' making contact with the inner surface of the recesses 46, 46' formed in the housing 41 of the compass head 4.

The adjusting spindle 30, the adjustment bearings 32, 32' and the adjusting wheel 31 are located at an axial distance a from the bearing axis z and in the middle relative to the adjusting axis x and the compass axis y. The pivot bearings 21, 21' are arranged at the ends 44, 44' of a bearing stirrup 43 which additionally has stabilizers 45, 45' which are transversely guided in recesses 26, 26' of the compass legs 2, 2' and which, in turn, are additionally equipped as scale carriers with a scale 62", 62'" each, wherein the scales, possibly in interaction with the inner edges of the compass legs 2, 2', facilitate an observation of the respective adjustment of the compass points.

A needle 51 and a lead 52 are clamped in the leg points 23, 23', wherein the leg points 23, 23' are provided with inner flattened portions 25, 25' in order to make it possible in an optimum manner to move the compass legs together into the "0" position of the compass 1.

A comparison of FIGS. 3 and 4 shows that the axial distance a is greater with closed compass legs than is the case with opened compass legs.

Figure 6:
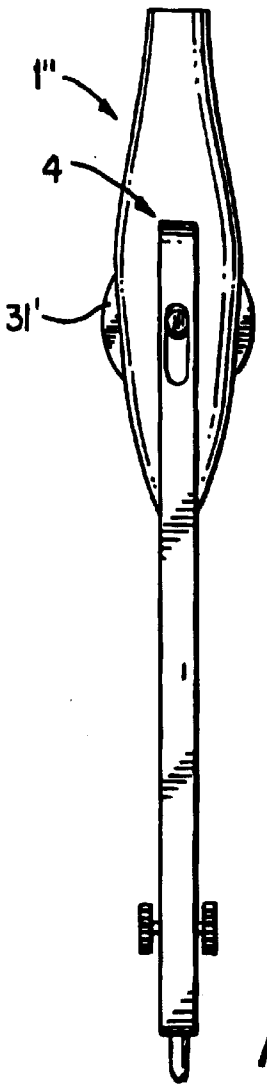
FIG. 6 is a side view of the compass of FIG. 5.
Figure 5:
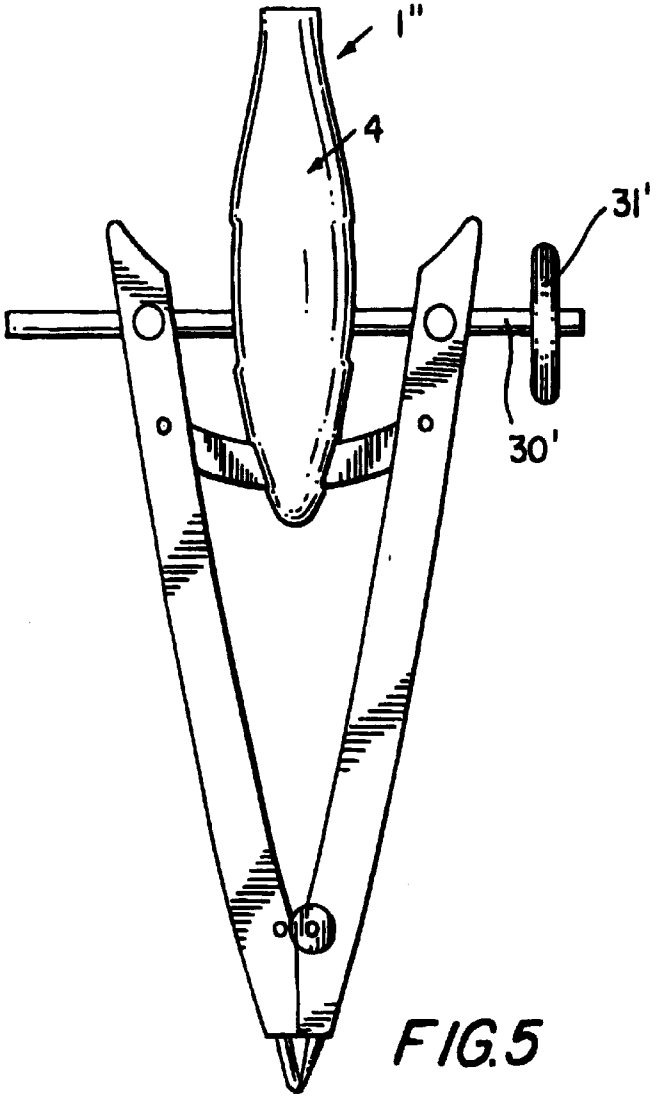
FIG. 5 is an elevational view of a third embodiment of the compass of the present invention, shown with closed compass legs.

FIGS. 5 and 6 of the drawing show a third embodiment of the compass 1", wherein FIG. 5 shows the compass legs in the closed position and FIG. 6 shows the compass from the side.

The compass 1" differs from the embodiments shown in FIGS. 2–4 only in that the adjusting spindle 30' has the adjusting wheel 31' mounted thereon not in the middle thereof, but on the right hand side. In addition, FIG. 6 shows the compass 1" from the side and shows that the adjusting wheel 30' protrudes radially beyond the compass head 4 even in the area of the greatest diameter of the compass head 4. The lead and the needle are in this case secured to the compass legs by means of tightening screws.

Figure 8:
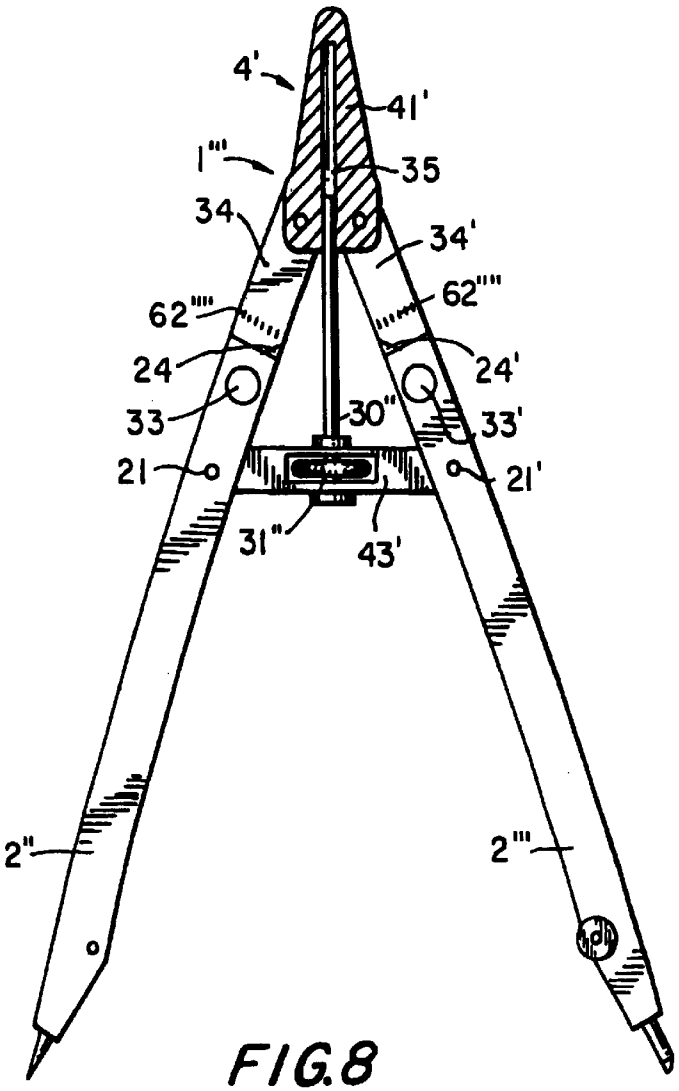
FIG. 8 is an elevational view, showing the compass of FIG. 7 with completely opened legs.
Figure 7:
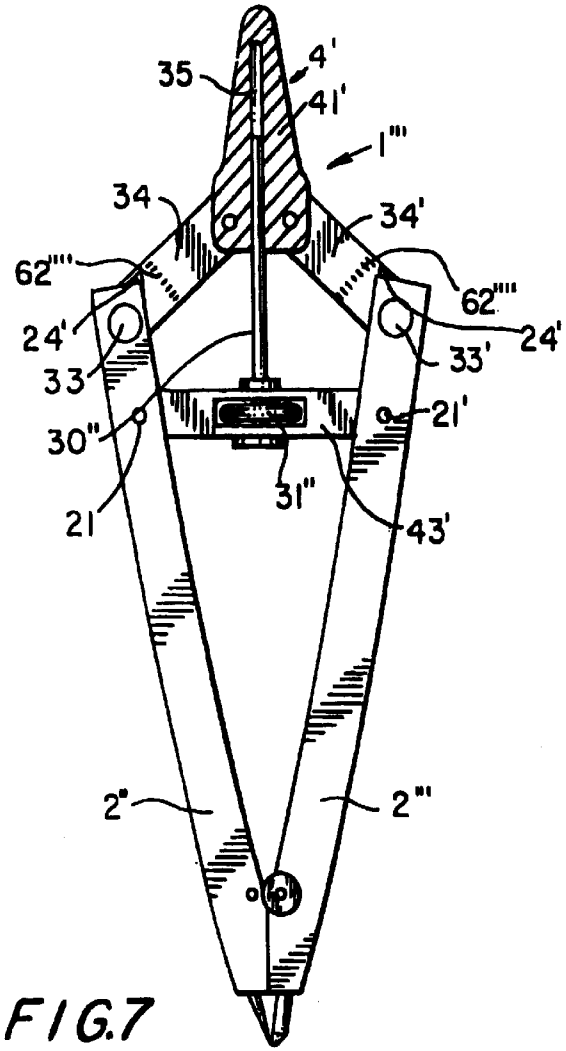
FIG. 7 is an elevational view of a fourth embodiment of the compass according to the present invention with a vertical adjusting spindle, shown with closed compass legs.

FIGS. 7 and 8 show another compass 1'" of a somewhat different construction, wherein FIG. 7 shows the compass in the closed position and FIG. 8 shows the compass in the opened position.

In addition to an adjusting spindle 30" extending vertically along the compass axis y, this compass 1'" has two tilting levers 34 and 34' which are rotatably mounted, on the one hand, in the housing 41' of the compass head 4' which is also provided with a grip 42' and, on the other hand, are fastened in an articulated manner to the leg ends 22' and 22'" in tilting bearings 33, 33'. In this embodiment, the adjusting wheel 31" is axially immovably mounted on a straight bearing stirrup 43' and the adjusting spindle 30" interacts with an adjusting thread 35 in the compass head 4'. When the compass is adjusted, the distance between the compass 4' and the bearing stirrup 43' changes in accordance with the axial spindle adjustment along the compass axis y, wherein the compass legs 2", 2'" are moved toward each other or away from each other in the area of the leg points. In the completely open position, the compass legs 2", 2'" and the corresponding tilting levers 34, 34' form an essentially straight line each. The tilting levers 34, 34' are provided with scales 62"", wherein indicators 24, 24' at the compass legs 2", 2'" indicate corresponding to the leg adjustment the change in the adjusting position about the pivot bearings 21, 21'.

The compasses 1, 1', 1", 1'" proposed in accordance with the present invention are usually equipped with two compass legs 2, 2'; 2", 2'" and an adjusting means 3, 3', 3" as well as possibly with other elements, wherein each compass leg 2, 2'; 2", 2'" has a pivot bearing 21, 21' and an adjustment bearing 32, 32' or a tilting bearing 33, 33'.

Each of the two compass legs 2 and 2' or 2" and 2'" is constructed as a two-armed lever, wherein the respective pivot point of the compass legs 2, 2' or 2", 2'" is a pivot bearing 21, 21' arranged on a bearing stirrup 43, 43', preferably at a perpendicular distance from the compass axis y.

The adjusting means 3, 3', 3" preferably is composed of an adjusting spindle 30, 30', 30" rotatably arranged in at least one adjustment bearing 32, 32' or in another adjustment thread 35, wherein the adjustment bearing 32, 32' or the respective tilting bearing 33, 33+ is arranged at the respective leg end 22, 22'; 22", 22'" of the compass legs 2, 2'; 2", 2'".

An adjusting thread 35 which may alternatively be provided is to be arranged in the compass head 4' or in the bearing stirrup 43' if an appropriate adjusting spindle 30" is arranged perpendicularly thereof, i.e., on the compass axis y.

The adjustment bearings 32, 32' are preferably constructed as spindle nuts and are arranged rotatably on the respective leg end 22, 22'.

It is particularly advantageous if the pivot bearings 21, 21' of the compass legs 2, 2', 2", 2'" are located on a bearing axis z and the adjustment bearings 32, 32' or the tilting bearings 33, 33' are located on an adjusting axis x, and if the bearing axis z is then spatially arranged between the adjusting axis x and the compass points 5, and not vice versa as has conventionally been common in the past. This means that each two-armed lever is practically reversed, so that the adjustability of the compass is optimized and the compass can be more easily manipulated during use because the adjusting distances have been shortened up to 60% and, when making circles of between 3 and 6 cm diameter which are the most frequent cases of application, the work pressure is uniformly distributed over both legs 2 and 2'. The bearing axis z and the adjusting axis x are to be spaced apart from each other by the possibly variable axial distance a, and the bearing axis z and the adjusting axis x extend essentially parallel to each other and perpendicular to the compass axis y.

The adjusting means 3, 3' preferably is an adjusting spindle 30, 30' which is arranged horizontally on the adjusting axis x and includes at least one adjusting wheel 31, 31', wherein the adjusting wheel 31, 31' is preferably arranged in the middle of the adjusting spindle 30, 30', but the adjusting wheel may also be arranged at the end of the adjusting spindle. An adjusting ball may also serve as an auxiliary adjusting means. If the adjusting wheel 31 arranged in the middle is adjusted with respect to its diameter to the size of the compass head 4 in such a way that only a small circumferential portion of the adjusting wheel 31 protrudes beyond the compass head 4, it is possible to achieve only a small adjustment or change of the compass points per each possible rotation, so that this results essentially in a fine adjustment. In accordance with an advantageous feature, it is also possible for effecting a coarse adjustment to provide a second adjusting wheel or an adjusting ball at one of the ends of the spindle and, since the rotary movements are not impaired at that location, it is possible to quickly turn the spindle and carry out the adjustment of the compass points relatively quickly.

It is also advantageous if the compass has a compass head 4 and a grip 42 and if the adjusting means 3 is rotatably mounted in the compass head 4 while being fixed in the direction of the adjusting axis x.

In accordance with another advantageous feature, the compass preferably has at the compass head 4, 4' a bearing stirrup 43, 43' at whose ends 44, 44' are arranged the pivot bearings 21, 21' for the respective compass legs 2, 2'; 2", 2'". It has been found useful in this connection if the pivot bearings 21, 21' at the bearing stirrup 43, 43' have a middle distance from or relative to the compass axis y which is 0.5 cm to 3.5 cm, preferably 1 cm to 2 cm. The most suitable distance depends also on the length of the compass legs, and on the distance of the pivot bearings 21, 21' from the adjustment bearings 32, 32' or the tilting bearings 33, 33' on the leg axis s. It is also advantageous in this connection if the bearing axis z and the adjusting axis x have an axial distance a between each other which is 0.5 cm to 2.5 cm, preferably 1 cm to 1.5 cm. This axial distance a may be fixed or may be variable within certain limits during the adjustment of the compass points 5 if this is structurally better or generally required. If the axial distance a is adjustable, the adjusting spindle 30, 30' and thus, the adjusting axis x changes its position, wherein the adjusting wheel 31 also changes its position along the compass axis y. When the compass points are closed, the distance to the bearing axis z becomes greater and when the compass is opened, the distance becomes smaller, particularly in the case of large opening positions of the compass which significantly exceed the parallel position of the compass legs.

The distance of the centers of the pivot bearings 21, 21' on the bearing axis z and the distance of the centers of the adjustment bearings 32, 32' or the tilting bearings 33, 33' on the adjusting axis x should advantageously deviate from each other in such a way that, when the compass points 5 or the leg points 23, 23' contact each other, the leg axes s in the areas of the bearings have an angle deviation a relative to the compass axis y or the parallel lines y', y" to the compass axis y, which is 3 degrees to 10 degrees, preferably 5 degrees to 7 degrees.

In the compass 1'" according to FIGS. 1 and 8, the adjusting means 3" can advantageously include an adjusting spindle 30" located on the compass axis y perpendicularly to the adjusting axis x and an adjusting wheel 31" which is rotatably but axially immovably mounted on the bearing stirrup 43' or in the housing 41' of the compass head 4'. The perpendicularly arranged adjusting spindle 30" of the adjusting means 3" interacts with an adjusting thread 35 which is fixedly arranged in the compass head 4' or the bearing stirrup 43'. In addition, in this compass 1'", tilting levers 34, 34' are rotatably mounted in an articulated manner in the compass head 4', wherein the tilting levers 34, 34' interact with tilting bearings 33, 33' arranged at the leg ends 22", 22'", possibly also interacting in an articulated manner, wherein the tilting levers 34, 34' form with the compass legs 2" and 2'" an essentially straight line when the compass 1'" is completely opened.

For improving the stabilization in transverse direction, the compasses 1, 1', 1" according to the present invention have in the compass head or in the housing 41 thereof recesses 46, 46' in which the leg ends 22, 22' of the compass legs 2, 2' are laterally guided and, thus, are stabilized in transverse direction, particularly in the case of large adjustments.

In addition, the bearing stirrups 43 should have stabilizers 45, 45' which are laterally guided in recesses 26, 26' of the compass legs 2, 21', so that the compass legs 2, 2' are additionally transversely stabilized, particularly in the case of medium and small adjustments.

Particularly advantageous relationships between the bearings and the compass points can be achieved if the compass legs 2, 2' are constructed in an arched configuration along the compass axis y, wherein the leg points 23, 23' extend slightly inwardly arched.

As a result of the configuration of the compasses proposed in accordance with the present invention, it is particularly easy to provide a relatively easily usable scaling. For this purpose, the compass should have at least one adjusting scale 6, wherein scales 62, 62', 62", 62'", 62"" arranged on a scale carrier 61, on the stabilizers 45, 45' or on the tilting levers 34, 34' or on other components can interact with one or more indicators 24, 24' arranged on the compass legs 2, 2', or with edges, markings or other indicating means in order to indicate the adjusted diameter or radius in such a way that it can be directly read with approximate accuracy in centimeters, in inches or other scales.

While specific embodiments of the invention have been shown and described in detail to illustrate the inventive principles, it will be understood that the invention may be embodied otherwise without departing from such principles.

We claim:

1. A compass comprising two compass legs and an adjusting means for the compass legs, wherein each compass leg has an axis, a leg end and a leg point opposite the leg end, further comprising a pivot bearing and an adjustment bearing mounted on each compass leg, each compass leg being constructed as a two-armed lever having a first lever arm and a second lever arm extending in opposite directions from the pivot bearing, the first lever arm extending along the leg axis from the pivot bearing to the leg point and the second lever arm extending from the pivot bearing to the leg end, wherein the adjusting means act on the adjustment bearings, and wherein the adjustment bearings are mounted in the second lever arms of the compass legs.

2. The compass according to claim 1, further comprising a bearing stirrup connected to the pivot bearings forming the pivot points of the compass legs, wherein the pivot bearings are mounted on the bearing stirrup at a perpendicular distance from a compass axis.

3. The compass according to claim 2, wherein the adjusting means comprises an adjusting spindle arranged rotatably in at least one of the adjustment bearings.

4. The compass according to claim 1, wherein the adjustment bearings are arranged at the leg ends.

5. The compass according to claim 3, wherein the compass comprises a compass head, and wherein an adjusting thread is arranged in one of the compass head and the bearing stirrup.

6. The compass according to claim 1, wherein the adjustment bearings are comprised of spindle nuts and are rotatably mounted on each compass leg end.

7. The compass according to claim 1, wherein a bearing axis extends through the pivot bearings and an adjusting axis extends through the adjustment bearings, wherein the bearing axis and the adjustment axis are spaced apart from each other by an axial distance, and wherein the bearing axis and the adjusting axis extend essentially parallel to each other and perpendicularly to a compass axis.

8. The compass according to claim 7, wherein the bearing axis is arranged at an axial distance between the adjusting axis and the leg points.

9. The compass according to claim 7, wherein the adjusting means comprises an adjusting spindle extending in the adjusting axis and comprising at least one adjusting wheel.

10. The compass according to claim 9, wherein the adjusting wheel is mounted in a middle of the adjusting spindle.

11. The compass according to claim 9, wherein the adjusting wheel is mounted at an end of the adjusting spindle.

12. The compass according to claim 7, further comprising a compass head and a grip mounted on the compass head, wherein the adjusting means is fastened in the compass head so as to be rotatable but fixed along the adjusting axis.

13. The compass according to claim 12, comprising a bearing stirrup fastened on the compass head, the bearing stirrup having ends, wherein the pivot bearings are mounted at the stirrup ends.

14. The compass according to claim 13, wherein the pivot bearings at the bearing stirrup have a center spacing from the compass axis of 0.5 cm to 3.5 cm.

15. The compass according to claim 14, wherein the spacing is 1 cm to 2 cm.

16. The compass according to claim 7, wherein the distance between the bearing axis and the adjusting axis is 0.5 cm to 2.5 cm.

17. The compass according to claim 16, wherein the distance is 1 cm to 1.5 cm.

18. The compass according to claim 7, wherein a center distance of the pivot bearings on the bearing axis and a center distance of the adjustment bearings on the adjusting axis deviate from each other such that, when the leg points are in contact with each other, the leg axes have an angle deviation relative to the compass axis which is 3° to 10°.

19. The compass according to claim 18, wherein the angle deviation is 5° to 7°.

20. The compass according to claim 1, comprising a compass head having a housing, and a bearing stirrup connecting the pivot bearings, wherein the adjusting means is comprised of an adjusting spindle extending on a compass axis and perpendicularly of an adjusting axis, and an adjusting wheel rotatably mounted but axially immovably held in one of the bearing stirrup and the housing of the compass head.

21. The compass according to claim 20, wherein the adjusting spindle is in engagement with an adjusting thread fixedly mounted in one of the compass head and the bearing stirrup.

22. The compass according to claim 21, wherein the adjustment bearings are configured as tilting bearings, further comprising tilting levers rotatably mounted in an articulated manner at the compass head, wherein the tilting levers are connected in an articulated manner to the tilting bearings.

23. The compass according to claim 1, further comprising a compass head, the compass head having recesses for laterally guiding the leg ends of the compass legs.

24. The compass according to claim 2, wherein the bearing stirrup has stabilizers, the compass legs having additional recesses, wherein the stabilizers are laterally guided in the additional recesses.

25. The compass according to claim 1, wherein the compass legs are constructed with an arched shape in the direction of a compass axis, and wherein the leg points extend slightly arched inwardly.

26. The compass according to claim 1, comprising at least one adjusting scale, further comprising indicators mounted on the compass legs and cooperating with the adjusting scale.

* * * * *